United States Patent [19]

Höglund et al.

[11] Patent Number: 4,847,006

[45] Date of Patent: Jul. 11, 1989

[54] ENCAPSULATED ION-EXCHANGE RESIN AND A METHOD FOR ITS MANUFACTURE

[76] Inventors: Lars O. Höglund, Stockholmsvägen 44, S-182 74 Stocksund, Sweden; Hubert R. Eschrich, Engelandlaan 1, B-2440 Geel, Belgium

[21] Appl. No.: 49,974

[22] PCT Filed: Aug. 29, 1986

[86] PCT No.: PCT/SE86/00387

§ 371 Date: Jun. 19, 1987

§ 102(e) Date: Jun. 19, 1987

[87] PCT Pub. No.: WO87/01502

PCT Pub. Date: Mar. 12, 1987

[30] Foreign Application Priority Data

Aug. 30, 1985 [SE] Sweden ..... 8504045

[51] Int. Cl.[4] ..... G21F 9/16; G21F 9/12

[52] U.S. Cl. ..... 252/628; 252/631; 252/633; 106/232; 106/276; 106/277; 106/273.1; 264/0.5; 264/DIG. 32; 366/69; 521/25

[58] Field of Search ..... 252/626, 628, 631, 633; 106/232, 246, 273 R, 273 N, 276, 277, 278; 264/DIG. 32, 0.5; 210/710, 751; 366/69, 85, 145

[56] References Cited

U.S. PATENT DOCUMENTS

| | | | |
|---|---|---|---|
| 3,142,648 | 7/1964 | Lefillatre et al. | 252/628 |
| 3,298,961 | 1/1967 | Davis et al. | 252/628 |
| 3,716,490 | 2/1973 | Van de Voorde | 252/628 |
| 3,971,732 | 7/1976 | Meier | 252/268 |
| 4,204,974 | 5/1980 | Puthawala et al. | 252/628 |
| 4,252,667 | 2/1981 | Stegmaier et al. | 252/628 |
| 4,460,499 | 7/1984 | Boden | 252/628 |
| 4,582,637 | 4/1986 | Kirkham | 252/628 |
| 4,661,290 | 4/1987 | Sauda et al. | 252/628 |
| 4,663,086 | 5/1987 | Lefillatre | 252/628 |

*Primary Examiner*—Howard J. Locker

*Attorney, Agent, or Firm*—Charles E. Baxley

[57] ABSTRACT

A method for long-term storage of radioactive waste in a solid bitumen is here taught. A granular ion-exchange resin (including radioactive ions) is mixed with a bitumen and water emulsion to produce a swollen aqueous product for encapsulation. The method is carried out at room temperature and optionally includes a cationic emulsion having a pH value of less than 4. The emulsion has a water content form 15–50% by weight and preferably is saturated with the water.

8 Claims, 2 Drawing Sheets

ENCAPSULATED ION-EXCHANGE RESIN AND A METHOD FOR ITS MANUFACTURE

The present invention relates to a solid bitumen product having embedded or encapsulated therein granular and/or pulverulent ion-exchange resin which is at least partially saturated with radioactive ions; and to a method for manufacturing the product; and to the use of the product for the long-term storage of radioactive waste of low and intermediate activity.

Energy producing power stations generate large quantities of radioactive waste, which must be converted to a form suitable for long-term storage. The major part of this waste, measured in volume, comprises waste of low and intermediate radioactivity. Most of this waste is concentrated in ion-exchangers, while a minor part is concentrated in evaporators. There are obtained in this way large quantities of radioactive ion-exchangers in granular and/or pulverulent form. The evaporation residues can also be converted to granular or pulverulent form.

When practising known methods, the resultant ion-exchangers are dried and then mixed with liquid bitumen, normally at a minimum temperature of 130° C. The resultant mixture is normally transferred into barrels, e.g. having a volumetric capacity of 200 l, in which the mixture is allowed to solidify and cool to ambient temperature, whereafter the barrels are sealed. The barrels are then placed in long-term storage locations of particular construction, e.g. rock cavities.

The known method of embedding dry ion-exchange resin in bitumen at high temperatures is encumbered with several drawbacks, of which the most serious reside in the risk of fire when using bitumen at high temperatures, and in the fact that the ion-exchangers are in a dry state. Dry ion-exchangers swell considerably when coming into contact with water. Consequently, should the dry ion-exchanger embedded in the bitumen come into contact with water, which is at least theoretically possible, there would be generated an extremely high swelling pressure sufficient to explode the encasing barrel and therewith spread the radioactivity throughout the surroundings. This risk, together with that of fire, has been a subject of criticism on the part of the authorities. Since the liquid bitumen has a high temperature, normally higher than 150° C., water present in the ion-exchange resin will depart upon contact of the resin with the bitumen, the resin therewith losing the major part of its water content. Water is also given off when pre-heating the ion-exchange resin prior to said mixing process. Consequently, when practicing known techniques, it is impossible for the ion-exchange resin embedded in solidified bitumen to be moist.

Other known methods and processes for treating radioactive material are found described in GB-A-959 751, CH-A-549 265, and FR-A-2 289 034, the radioactive material in these cases being mixed with a bitumen and water emulsion. The mixture is then heated to remove residual water, and hence the radioactive material is present in the bitumen in a dry state.

GB-A-2 116 355 describes a method in which ion-exchange resin having radioactive ions absorbed therein is encapsulated in bitumen. The radioactive ion-exchange resin and the bitumen are heated to extract water therefrom.

The objective of the present invention is to avoid the aforesaid drawbacks and to provide a novel and improved method of encapsulating ion-exchange resin in a solid bitumen matrix, in which subsequent to being encapsulated the ion-exchanger is in a wet, swollen form and with which there is no risk of fire during the actual working operation, and to enable the resultant product to be used for the long-term storage of radioactive waste of low and intermediate levels of activity.

This objective is achieved in accordance with the invention by mixing/combining the ion-exchange resin with a bitumen-water emulsion; by adding the ion-exchange resin, and optionally the waste material, to a given quantity of emulsion in an amount such that the break point of the emulsion is reached and the mixture transforms to a solid product, in which the ion-exchange resin is present in a swollen, aqueous form.

The method according to the invention affords many advantages in relation to known techniques, in that it is possible to use a moist ion-exchanger, thereby rendering it unnecessary to dry the ion-exchanger prior to its embedment. It is also possible, however, to use dry ion-exchanger that will swell when coming into contact with the water present in the aqueous emulsion. The aqueous emulsion can be used at ambient temperatures, therewith obviating the need to heat the bitumen.

A further advantage is that the ion-exchanger and bitumen can be mixed with the use of existing apparatus and equipment, although in this case without supplying thermal energy or minor forms of energy to the system, so as to ensure that no major evaporation of the water content of the emulsion takes place. The use of mixing appliances is not necessary, however, since the ion-exchanger can be added to the emulsion without mixing the two together.

Preferred embodiments of the invention are set forth in the depending claims.

The invention will now be described with reference to a number of preferred embodiments.

The foregoing features and advantages will appear more fully from the drawings wherein.

Figure 1:
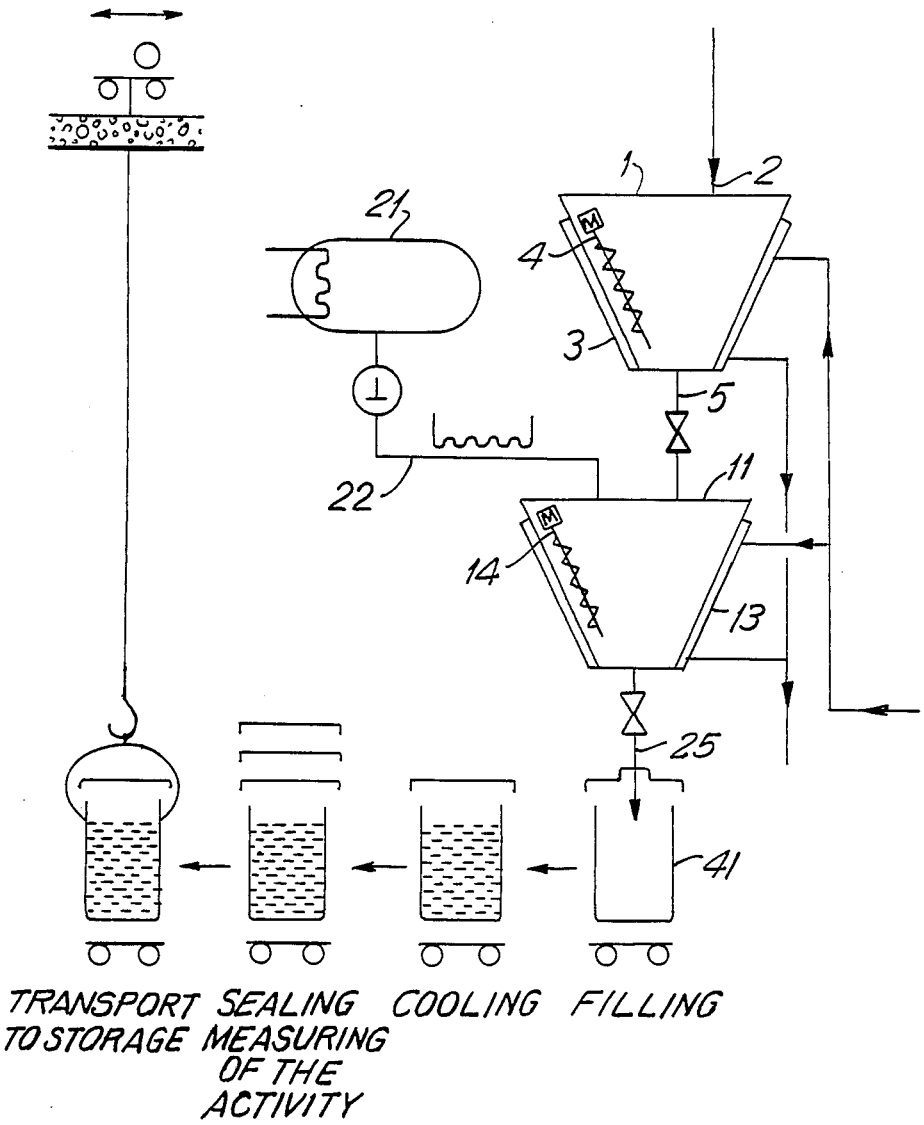
FIG. 1 illustrates schematically an embodiment of an ion-exchange resin in bitumen system in accordance with known techniques.

In the drawing the reference numberal 1 identifies a mixing tank for mixing together pulverulent ion-exchange resin, evaporator concentrate, and granular ion-exchange resin, delivered to the tank through a delivery conduit 2. The mixing tank 1 is provided with a heating jacket 3, through which the dry ion-exchanger is pre-heated with steam. A stirrer or agitator 4 provided with a motor is arranged in the tank 1. The pre-heated ion-exchange resin is passed through a conduit 5, which incorporates a valve, to a further mixing tank 11 which is provided with a heating jacket 13 and a stirrer or agitator 14. The tank 11 is heated with steam.

Liquid bitumen is passed from a bitumen tank 21 to the further mixing tank 11, through a heated conduit 22. The embedded ion-exchange resin obtained in the mixing tank 11 is transferred to a storage barrel 41, through a conduit 25. When full, the barrels are placed on one side for the bitumen and ion-exchange resin to cool. The barrels are then sealed with a respective lid and the activity of the barrel contents is measured, whereafter the barrels are moved to their place of storage. The bitumen arriving from the bitumen tank 21 has a temperature of a least 130° C., normally 150° C. and higher.

Partial degradation of the ion-exchange resin has been observed therewith.

According to the present invention there is used an emulsion of water and bitumen instead of liquid bitumen, the emulsion also containing emulsion stabilizing substances. Such emulsions are known to the art and are retailed under various tradenames. One example in this regard is the emulsion sold by Shell under the name "CARILAS". This emulsion is a cationic emulsion containing at most 30% by weight water and having a pH of at most 4. The water content of the emulsion varies in magnitude. Other, similar emulsions, both anionic and cationic, may contain up to 50% by weight water.

The ion-exchange resin used may be either cationic or anionic, depending on whether it is anions or cations that are dealt with. Normally there is used a mixed ion-exchanger, i.e. a blend of cation exchanger and anion exchanger in differing quantitative proportions.

According to a preferred embodiment a dry or moist ion-exchange resin is added to a given quantity of emulsion until reaching the break point of the emulsion, at which there is obtained a solidifying mass of bitumen which encapsulates the granular and/or pulverulent material and optionally separated water. This water is removed and treated in an ion-exchanger for removal of any radioactive ions present, or is evaporated-off. Other granular and/or pulverulent waste material, preferably radioactive waste, may also be added together with the ion-exchange resin.

When a dry ion-exchanger is used, the emulsion preferably has a higher water content than when using a moist ion-exchanger, since when coming into contact with water the dry ion-exchanger absorbs water and swells. When changing dry ion-exchangers to the system heat is generated, which in the case of vacuum-dried Dowex 50H+ constitutes about 30 cal/g of ion-exchanger.

In accordance with one particularly preferred embodiment the water content of the emulsion and the moisture content of the ion-exchange resin are so adapted that substantially no water is separated during solidification of the bitumen. In other words, the ion-exchange resin, until saturated and swollen, absorbs from the broken bitumen emulsion precisely so much water as to leave no residual water in the final product.

PREFERRED EMBODIMENT

Figure 2:
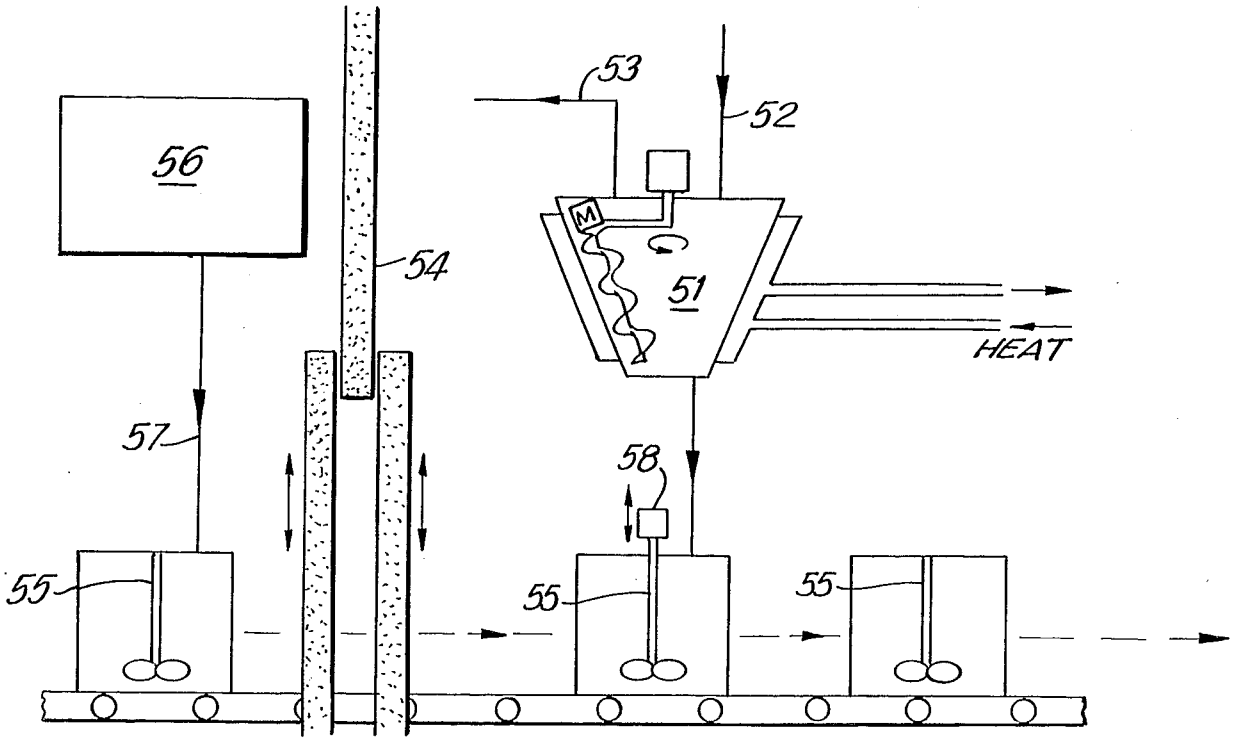
FIG. 2 illustrates schematically a preferred embodiment of ion-exchange resin in bitumen system in accordance with the present invention.

This embodiment will now be described in more detail with reference to the enclosed FIG. 2. Wet ion-exchange resin is charged in a dryer 51 through a conduit 52 and the resin is dried to a predetermined moisture content. Vapours developed during drying are discharged through a conduit 53. The dryer is preferably placed in a radioactively controlled area, separated from uncontrolled areas by means of walls 54. A bitumen emulsion is charged in one or more containers 55, provided with stirrers, from a storage tank 56 through a conduit 57. This operation may suitably be carried out in an uncontrolled area. The containers 55 are brought into the controlled area and the stirrers are connected to driving means 58. The ion-exchange resin is charged into the containers 55 during stirring until it is essentially homogenously distributed. The water in the emulsion is absorbed by the ion-exchange resin, which swells to its maximum volume, whereby the emulsion is broken and the product forms a solid mass. The stirring is discontinued and the driving means 58 are disconnected. The stirrers may be left in the containers to avoid the decontamination of them. After capping and sealing, the containers are ready for final storage.

The method can be carried out advantageously in existing equipment and apparatus, such as the apparatus illustrated in the drawing. In this case, however, the jacketed tanks 1 and 11 are operated with water instead of steam,or preferably no heating step is applied. In the absence of preheating, the ion-exchange resin is passed directly to the tank 11, optionally together with other waste material to be embedded with said resin. Instead of containing bitumen the tank 21 contains an emulsion of water and bitumen, for example "CARILAS" when the ion-exchanger used is a cation exchanger, this exchanger being the one preferred. Ion-exchanger and emulsion can be supplied to the process continuously or batchwise, and the matrix of bitumen with encapsulated ion-exchanger can be removed from the tank 11 and delivered to the barrel 41 either continuously or batchwise. Water, which is optionally separated from the system in the tank 11, can be removed continuously.

According to one highly preferred embodiment ion-exchange resin is supplied to the emulsion in an amount which results in solidification, said ion-exchange resin being optionally supplied together with other material to be encapsulated, such as radioactive or toxic material, or material which is harmful in some other way. Any water that may form is removed prior to sealing the barrel for terminal storage purposes.

The method is carried out within a temperature range of 1°-90° C., preferably 5°-60° C. A particularly preferred temperature in this regard is room temperature or ambient temperature, which ambient temperature must be higher than 1° C., preferably higher than 5° C. This obviates the need of pre-heating the system components.

The solid product resulting from the embedment process can be heated or maintained at a temperature of 50°-60° C. in order to shorten the time taken for the product to solidify. This subsequent treatment of the product is not necessary however.

When practicing the method according to the present invention the ion-exchanger may have a pulverulent form or a granular form, and particular preference is given to the use of a moist ion-exchanger. Pulverulent and granular evaporation residues can also be incorporated together with the ion-exchange resin. It has been found that the resultant product can contain more then 50% by volume particulate material.

It has been found that no appreciable losses of water in the ion-exchange resin are experienced when heating the resultant, full solidified product for two hours at 150° C. On the other hand, a volatile fraction of the bitumen is vaporized off.

We claim:

1. A solid bitumen product for long term storage of radioactive waste and having encapsulated therein a granular ion-exchange resin, said ion-exchange resin being at least partially saturated with radioactive ions the product characterized in that the ion-exchange resin is in a swollen aqueous form.

2. A method for producing a solid bitumen product for long term storage of radioactive waste having encapsulated therein a granular ion-exchange resin including radioactive ions, the method characterized by mixing the ion-exchange resin with a bitumen and water emulsion, and by adding the ion-exchange resin to the emulsion in an amount at which the break point of the emulsion is reached and the mixture is transformed to a solid product in which the ion-exchange resinis present in a swollen aqueous form.

3. The method according to claim 2 characterized further is that the mixing is carried out with the ion-exchange resin in a moist swollen condition.

4. The method according to claim 2 characterized further in that the mixing is initiated with the ion-exchange resin in dry condition.

5. The method according to claim 2 characterized further by being carried out at a temperature of from 5-60% C.

6. The method according to claim 2 characterized further by inclusion in the mixing of a cationic emulsion having a pH value lower than 4.

7. The method according to claim 2 characterized further in that the emulsion has a water content of from 15-50% by weight.

8. The method according to claim 2 characterized further in that the emulsion has a water content of from 15-30% by weight.

* * * * *